US006996863B2

(12) United States Patent
Kaneko

(10) Patent No.: US 6,996,863 B2
(45) Date of Patent: Feb. 14, 2006

(54) AUTOMATIC FAUCET CONTROL DEVICE AND CONTROL METHOD

(75) Inventor: Yoshiyuki Kaneko, Fukuoka (JP)

(73) Assignee: Toto Ltd., Fukuoka (JP)

( * ) Notice: Subject to any disclaimer, the term of this patent is extended or adjusted under 35 U.S.C. 154(b) by 69 days.

(21) Appl. No.: 10/489,823

(22) PCT Filed: Sep. 24, 2002

(86) PCT No.: PCT/JP02/09805

§ 371 (c)(1),
(2), (4) Date: Mar. 17, 2004

(87) PCT Pub. No.: WO03/029572

PCT Pub. Date: Apr. 10, 2003

(65) Prior Publication Data

US 2005/0000015 A1 Jan. 6, 2005

(30) Foreign Application Priority Data

Sep. 27, 2001 (JP) ..... 2001-297375

(51) Int. Cl.
*E03C 1/05* (2006.01)

(52) U.S. Cl. ..... 4/623; 4/302; 4/304

(58) Field of Classification Search ..... 4/302, 4/304, 623
See application file for complete search history.

(56) References Cited

U.S. PATENT DOCUMENTS 4,872,485 A * 10/1989 Laverty, Jr. ..... 137/624.11
5,819,336 A * 10/1998 Gilliam et al. ..... 4/623

FOREIGN PATENT DOCUMENTS

| | | |
|---|---|---|
| JP | 61-221428 | 10/1986 |
| JP | 61-259189 | 11/1986 |
| JP | 63-254774 | 10/1988 |
| JP | 5-295772 | 11/1993 |
| JP | 7-233548 | 9/1995 |
| JP | 7-281130 | 10/1995 |

* cited by examiner

*Primary Examiner*—Justine R. Yu
*Assistant Examiner*—Huyen Le
(74) *Attorney, Agent, or Firm*—Wenderoth, Lind & Ponack, L.L.P.

(57) ABSTRACT

An automatic faucet control device including an electromagnetic valve for opening and closing a flow channel of a faucet, a ray emitting device (5) for emitting infrared rays to a target to be detected, a ray receiving device (6) for receiving the infrared rays reflected by the target, a sensing decision device for the deciding presence or absence of the target by an output from the ray receiving device (6), and an electromagnetic valve controller for controlling the electromagnetic valve based on a signal from the sensing decision device. The ray emitting device (5) has a first polarizing plate (7) allowing a polarized light component to be transmitted, and the ray receiving device (6) has a second polarizing plate (8) for allowing a polarized light component different from the rays transmitted through the first polarizing plate (7) to be transmitted therethrough.

4 Claims, 4 Drawing Sheets

AUTOMATIC FAUCET CONTROL DEVICE AND CONTROL METHOD

TECHNICAL FIELD

The present invention relates to an automatic faucet control device used for hand-washing or the like, which detects an object to allow water to automatically run, and to a control method.

BACKGROUND ART

An automatic faucet detects user's hands in a toilet or lavatory and a dish or a pan in a kitchen or the like to allow water to automatically run. Such an automatic faucet is widely used because of its convenience, cleanness, water-saving performance, and the like. As a sensor mounted to the automatic faucet to detect an object for which the water is allowed to run, an infrared sensor is used in almost all the cases.

Not only the automatic faucets but any faucet device is attached to a device for receiving running water and draining it, for example, to a washbowl or a washbasin in a toilet and to a sink in a kitchen.

FIG. 1 is a cross-sectional view showing a state where an automatic faucet according to a conventional example is attached to a washbasin. The reference numeral 10 denotes a washbasin. A faucet main body 11 of an automatic faucet is mounted to the washbasin 10. The faucet main body 11 has a sensor housing section 12 formed in its stem. In the sensor housing section 12, the above-described infrared sensor is housed. At a tip of the faucet main body 11, a spout 13 is provided.

It is preferred that a detecting direction of the sensor for emitting and receiving rays and a water running direction are parallel in view of convenience. As shown in FIG. 1, a ray emitting and receiving direction of the sensor is directed toward the washbasin 10. The sensor emits infrared rays. If an amount of reflected rays thereof exceeds a predetermined value, that is, if the amount of the reflected rays is large, it is generally determined that something is sensed. There is also a method of detecting not simply the amount of reflected rays but a change such as the movement of hands or the like (Unexamined Japanese Patent Publication No. Hei 7-233548). However, it is basically determined that something is sensed when the amount of reflected rays becomes large.

When the detection direction is viewed from the sensor, the surface of the washbasin 10 is present behind the hands corresponding to a target to be detected. However, since the distance from the sensor to the washbasin 10 is large compared with the distance to the hands, the amount of reflected rays of the infrared rays from the washbasin 10 is small. Therefore, normally, the sensor does not erroneously detect the washbasin 10. This is because material of a washbasin is generally a ceramic and infrared rays cause diffuse reflection on its surface as in the case of hands.

However, even if the washbasin is made of a ceramic, some kinds of ceramics are highly glossy. Furthermore, some washbasins are made of material other than ceramics, such as glass or stainless steel. Moreover, a kitchen sink is generally made of stainless steel. In such a case, even if the distance from the sensor to the washbasin or the sink is large, infrared rays emitted from the sensor cause specular reflection on their surfaces to generate reflected rays at an extremely high level. As a result, the sensor erroneously senses the washbasin, the sink or the like as an object such as a hand, and thus the automatic faucet erroneously allows water to run.

In order to avoid specular reflection, there is a method of orienting the sensor in another direction, for example, in a horizontal direction. However, the place where a user intends to wash their hands is in a washbasin because water splashes do not cause any trouble there. If the sensor is oriented in a direction other than the direction toward the washbasin, the action area of the user does not conform to the detection area of the sensor. Accordingly, it is extremely inconvenient to use.

In order to prevent an erroneous water flow, there are a sensor of which sensitivity can be adjusted at the place where the device is placed and a sensor in which signal processing has been modified as described in the above-mentioned Unexamined Japanese Patent Publication No. Hei 7-233548. However, they are effective only for small specular reflection. Thus, in practice, only the limited types of washbasin or sink can be used in combination with the automatic faucet. Moreover, the effects cannot be confirmed until the device is placed.

A method of selecting a sensor which does not use any ray reflection, such as an ultrasonic sensor, is also conceived. However, a sensor for the automatic faucet needs perfect waterproofing property, and the sensor is not allowed to have large size in view of design of the faucet. Accordingly, such a sensor is not preferred. Thus, in consideration of waterproofing property and the size, the infrared ray sensor is most suitable for the required specifications of the automatic faucet. Therefore, it has been an important issue to eliminate the effects of specular reflection.

The present invention was devised to solve the above problem and to provide an automatic faucet control device using a small infrared ray system sensor excellent in waterproofing property, which does not erroneously sense a washbasin or a sink of any materials as well as a control method thereof.

SUMMARY OF THE INVENTION

In order to achieve the above object, an automatic faucet control device has a detection means for detecting infrared rays of emitted infrared light, the infrared rays being incident on a target to be detected and being reflected thereby, so as to sense the target coming closer to a spout and then to allow water to automatically run, wherein the detection means comprises a first polarization means for allowing a linearly polarized component of the emitted infrared rays to be transmitted therethrough and a second polarization means for allowing a linearly polarized component of received infrared rays to be transmitted, and planes of polarization of the first polarization means and the second polarization means cross each other.

Here, a polarizing direction means a direction of an oscillating electric field of a polarized component passing through the polarization means, and a plane of polarization means a plane perpendicular to a surface of the polarizing plate, which contains both a traveling direction of the polarized component and the direction of the oscillating electric field.

The infrared rays emitted from the detection means is transmitted through the first polarization means and then converted into linearly polarized light having one plane of polarization. The linearly polarized light is incident on the target to be detected and diffuse-reflected. A part thereof is transmitted through the second polarization means so as to be linearly polarized light having a plane of polarization crossing the above-mentioned plane of polarization. The detection means detects the linearly polarized light transmitted through the second polarization means. The automatic faucet control device senses the approach of the target to be detected based on the detection of the linearly polarized light by the detection means so as to allow water to automatically run.

On the other hand, when the linearly polarized light from the detection means is incident on a mirror-faced object such as a sink behind the target to be detected, the linearly polarized light is incident on the mirror-faced object to be reflected thereby. However, since it does not cause any diffuse reflection, the incident rays on the mirror-faced object and the reflected rays thereby have the same plane of polarization. Even if the linearly polarized light is incident on the second polarization means, the linearly polarized light, which is mirror-reflected, can not be transmitted through the second polarization means because the plane of polarization of the linearly polarized light incident on the second polarization means crosses the plane of polarization of the linearly polarized light transmitted through the second polarization means. As described above, while the mirror-reflected infrared rays, which is an adverse signal, is removed, the reflected rays from the target such as a hand can be detected.

An automatic faucet control device comprises: an electromagnetic valve for opening and closing a flow channel of a faucet, a ray emitting means for emitting infrared rays to a target to be detected, a ray receiving means for receiving the infrared rays reflected by the target, a sensing decision means for deciding presence or absence of the target by an output from the ray receiving means, and an electromagnetic valve control means for controlling the electromagnetic valve based on a sensing signal from the sensing decision means, wherein the ray emitting means has a first polarization means for allowing a linearly polarized component to be transmitted, and the ray receiving means has a second polarization means for allowing a linearly polarized component in a direction different from that of the rays transmitted through the first polarization means to be transmitted. Accordingly, the mirror-reflected infrared rays, which cause an adverse signal, is removed to ensure the detection of the reflected rays from a hand or the like.

In the automatic control device, the first and the second polarization means are polarizing plates provided so that their planes of polarization perpendicularly cross each other. Therefore, the automatic faucet control device does not have a larger size compared with a conventional infrared sensor, and it prevents erroneous sensing while maintaining the advantages of the infrared sensor.

The invention is also directed to a control method for an automatic faucet for detecting infrared rays of emitted infrared light, the infrared rays being incident on a target to be detected and being reflected thereby, so as to sense the target coming closer to a spout to allow water to automatically run. The method includes the steps of: emitting the infrared rays to a first polarization means to allow a linearly polarized component to be transmitted therethrough so that the linearly polarized component is incident on an object, and allowing reflected rays of the linearly polarized component reflected by the object to be incident on a second polarization means having a plane of polarization crossing a plane of polarization of the first polarization means so as to detect only a linearly polarized component transmitted through the second polarization means.

In the case where the object is a target to be detected, the reflected rays are diffuse-reflected on the surface of the target. Therefore, a part of the rays is transmitted through the second polarization means to be detected. In the case where the object causes specular reflection, a polarizing direction of the reflected rays becomes identical with a polarizing direction of the infrared rays transmitted through the first polarization means. Therefore, the reflected rays cannot be transmitted through the second polarization means, and therefore is not detected. In this manner, it is ensured that only the target is detected to prevent erroneous sensing.

DETAILED DESCRIPTION OF THE INVENTION

Figure 2:
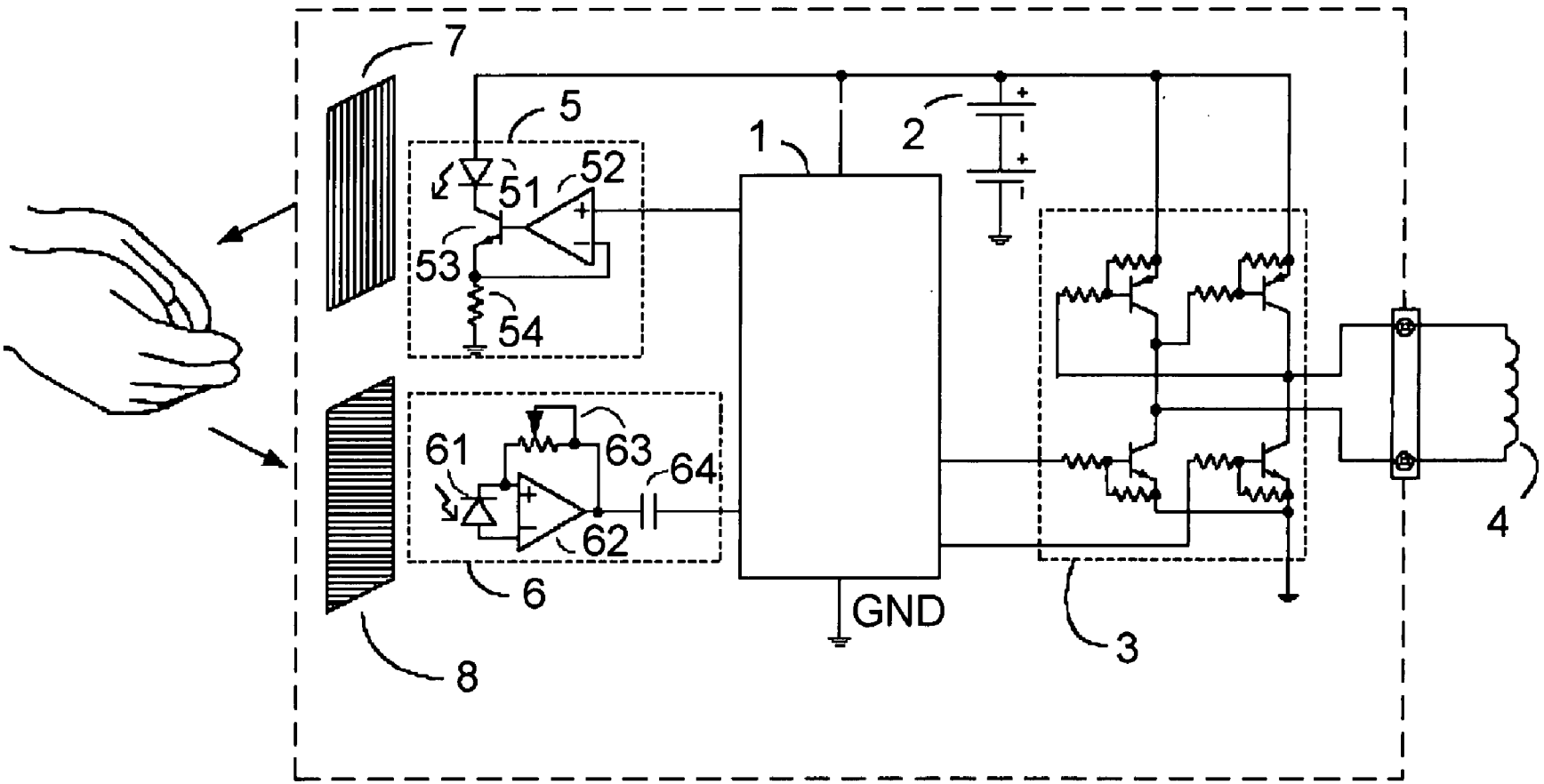
FIG. 2 is a view showing the configuration of an automatic faucet control device according to the present invention.

The present invention will be described in detail based on an embodiment shown in FIGS. 2 to 5. FIG. 2 is a view showing the configuration of an automatic faucet control device according to the present invention. In FIG. 2, the reference numeral 1 denotes a microcomputer which controls all operations of an automatic faucet, such as driving of an infrared sensor, sensing decision processing of the sensor, and driving of an electromagnetic valve based on the result of sensing. The reference numeral 2 denotes a battery serving as a power source; the reference numeral 4 denotes a solenoid corresponding to the electromagnetic valve for opening and closing a water channel of the automatic faucet; and the reference numeral 3 denotes a solenoid energizing circuit for energizing the solenoid 4.

The reference numerals 5 and 6 constitute ray emitting and receiving sections of the infrared sensor. The reference numeral 5 denotes a ray emitting section (ray emitting means) of the sensor, which is composed of a constant-current driving circuit constituted by an infrared light emitting diode 51, an operation amplifier 52, a transistor 53, and a resistance 54. The ray emitting section is driven by the microcomputer 1 to emit pulsed infrared rays of a predetermined intensity.

A pulsed voltage is applied from the microcomputer 1 to the operation amplifier 52 so as to allow a pulsed constant current to flow through the infrared light emitting diode 51. Therefore, the microcomputer 1 can optionally control a current value of the emitted pulsed rays, that is, an output intensity and timing of the infrared rays.

The reference numeral 6 denotes a ray receiving section (ray receiving means) of the sensor composed of: a current-voltage conversion circuit constituted by a photodiode 61, an operation amplifier 62, and a variable resistance 63; and a capacitor 64. The ray receiving section converts reflected infrared rays from a detected target into a voltage so as to output it. A level of the output voltage, that is, light-receiving sensitivity can be adjusted by the variable resistance 63. A direct-current component of a signal is removed by the capacitor 64 so that only an alternating current component corresponding to pulsed rays outputted from the ray emitting section 5 is outputted to the microcomputer 1. The ray emitting section 5 and the ray receiving section 6 constitute a detection means.

As described above, the microcomputer 1 drives the ray emitting section 5 in a pulsed manner so as to generate a predetermined infrared rays output, and reads the output of the ray receiving section 6 at the timing in synchronization with it. While periodically repeating it, if the output of the ray receiving section 6 exceeds a predetermined threshold value, a sensing decision means included therein determines that a target to be detected is present. Then, an electromagnetic valve control means included therein drives the solenoid energizing circuit 3 to energize the solenoid 4 so that the electromagnetic valve is in an open state, thereby performing a water flow operation. On the contrary, when the output from the ray receiving section 6 drops under the threshold value, the electromagnetic valve control means energizes the solenoid 4 so that the electromagnetic value is in a closed state, thereby stopping a water flow.

The threshold value for deciding to allow water to run or to stop is comprehensively determined in consideration not only of the characteristic of ray emitting and receiving elements but also of a voltage applied to the ray emitting section 5, a value of the resistance 54, an adjustment value of the variable resistance 63, and the like.

The above-described structure including the microcomputer 1 through the ray receiving section 6 is the same as that of a conventionally known automatic faucet.

The reference numeral 7 denotes a polarizing plate mounted to the ray emitting section 5. The polarizing plate 7 permits the transmission of only a vertically oscillating component (linearly polarized component) of the infrared rays outputted from the infrared light emitting diode 51, which has no polarizing characteristics, so as to output it toward the target to be detected such as a hand. The polarizing plate 7 uses, as a plane of polarization, a plane vertical to the surface of the polarizing plate 7, which contains a traveling direction of the polarized light and a vertical direction (polarizing direction) corresponding to a direction of an oscillating electric field.

The reference numeral 8 denotes a polarizing plate mounted to the ray receiving section. The polarizing plate 7 and the polarizing plate 8 are arranged so that the respective polarizing directions perpendicularly cross each other, that is, their planes of polarization perpendicularly cross each other. The polarizing plate 8 permits the transmission of only a horizontally oscillating component (linearly polarized component) of the reflected rays from the target to be detected so as to input it to the photodiode 61.

The "vertical direction" and the "horizontal direction" in the above description are directions in the drawings for convenience of illustration, and do not limit an actual state of placement of the automatic faucet.

Figure 1:
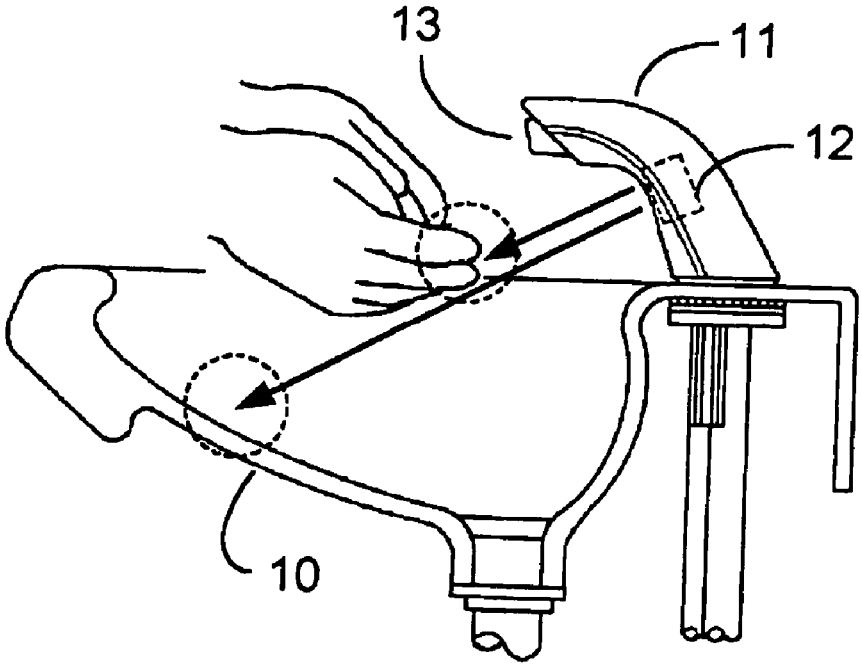
FIG. 1 (PRIOR ART)
FIG. 1 is a cross-sectional view showing a state where an automatic faucet according to a conventional example is placed.

The polarizing plates 7 and 8 as well as the ray emitting section 5 and the ray receiving section 6 of the sensor can be housed within the sensor housing section 12 shown in FIG. 1 for use.

The sensor housing section 12 may be provided at the tip end portion of the faucet main body 11 together with the spout 13. If possible, not only the ray emitting and receiving sections of the sensor but also all the circuits such as the microcomputer 1 may be housed therein.

In FIG. 1, the infrared rays emitted from the sensor housing section 12 cause diffuse reflection on the surfaces of the hands in the case of hand-washing. However, if hand-washing does not take place, the infrared rays reach the washbasin to cause diffuse reflection or specular reflection depending on a material or a surface state of the washbasin.

Figure 3:
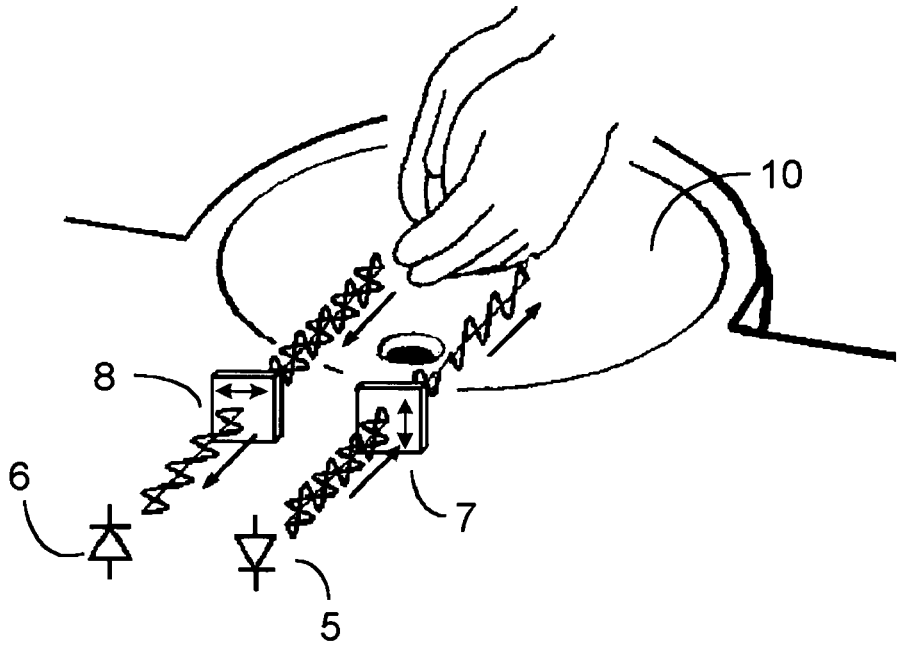
FIG. 3 is a perspective view showing a hand-washing state, illustrating the principle of the present invention.
Figure 4:
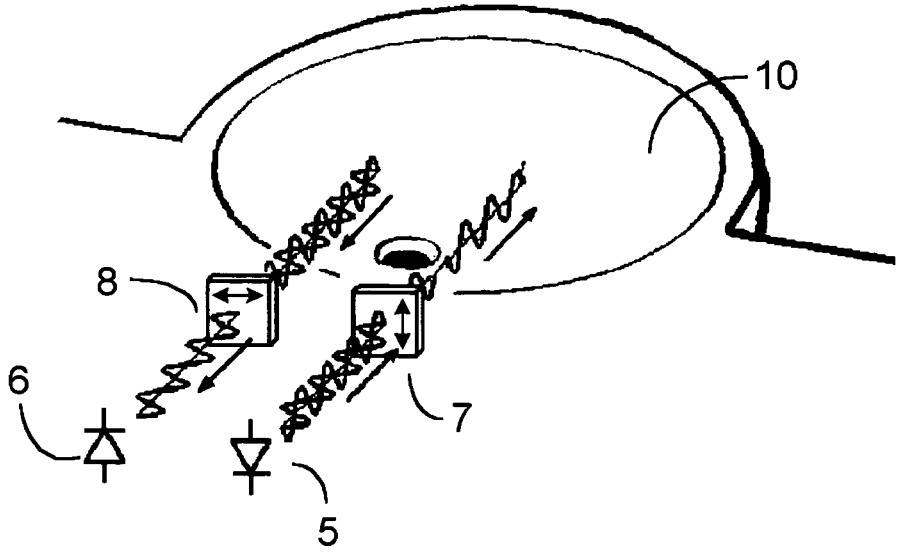
FIG. 4 is a perspective view showing a state where diffuse reflection is caused on a surface of a washbasin, illustrating the principle of the present invention.
Figure 5:
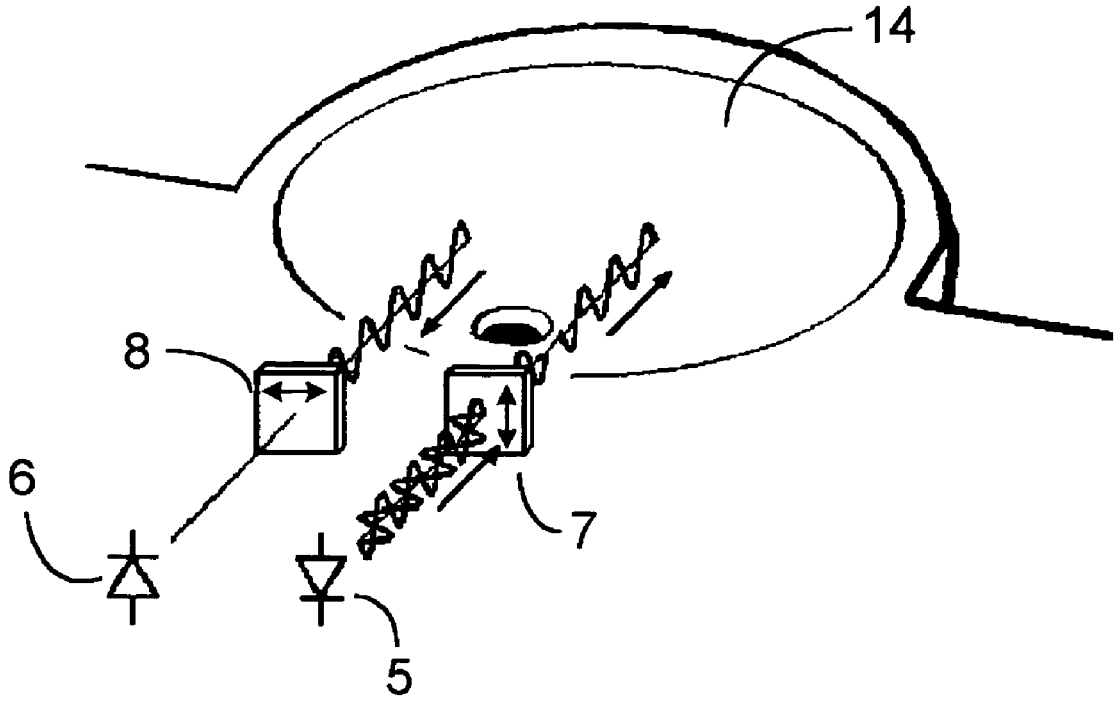
FIG. 5 is a perspective view showing a state where specular reflection is caused on a surface of a washbasin, illustrating the principle of the present invention.

FIGS. 3 to 5 are perspective views seen from the sensor side opposite to a user. In each of the drawings, the directions indicated with arrows in the polarizing plates 7 and 8 represent the polarizing directions of the respective polarizing plates 7 and 8. FIG. 3 is a perspective view showing a state of the infrared rays in the case where a user of the automatic faucet is washing their hands.

In FIG. 3, after the infrared rays outputted from the ray emitting section 5 are transmitted through the polarizing plate 7, they become infrared rays containing only a vertically oscillating component (linearly polarized component). Since the infrared rays cause diffuse reflection on the surfaces of the hands, the oscillating components of the reflected rays include both a component in a vertical direction and a component in a horizontal direction. The polarizing plate 8 allows only a horizontally oscillating component (linearly polarized component) of the reflected rays to be transmitted so that it enters the ray receiving section 6.

The infrared rays are attenuated with losing a particular polarized component as being transmitted through the polarizing plates 7 and 8. However, by appropriately setting an output of the emitted rays from the ray emitting section 5, light-receiving sensitivity of the ray receiving section 6, and a sensing decision threshold value of the microcomputer 1, it is easy to detect a target to be detected such as hands in the case of hand-washing.

FIG. 4 is a perspective view showing the case where the infrared rays from the sensor cause diffuse reflection on the surface of the washbasin in the absence of a user. As shown in FIG. 4, when the infrared rays emitted from the ray emitting section 5 are transmitted through the polarizing plate 7, they become infrared rays containing only a vertically oscillating component. The diffuse reflection is highly likely to occur on the surface of the washbasin 10, in particular, in the case of a washbasin made of ceramic, and thus the oscillating components of the reflected rays include both a component in a vertical direction and a component in a horizontal direction. The polarizing plate 8 allows only a horizontally oscillating component of the reflected rays to be transmitted so that it enters the ray receiving section 6.

As described above, the ray receiving section 6 detects the reflected rays from the washbasin 10. However, since the diffuse-reflected rays are uniformly spread omnidirectionally from the surface of reflection, the amount of received rays becomes smaller as the distance between the sensor and the object causing reflection (the washbasin 10) is increased. Therefore, it does not exceed the amount of received reflected rays from the hands which come closer to the sensor. Accordingly, an erroneous water flow is not caused.

FIG. 5 is a perspective view showing the case where the infrared rays from the sensor cause specular reflection on the surface of the washbasin in the absence of a user. The specular reflection is likely to occur in the case where a material of the washbasin is highly glossy ceramic, stainless steel, glass and the like. The reference numeral 14 denotes a washbasin made of these mirror-reflective materials.

As shown in FIG. 5, when the emitted infrared rays from the ray emitting section 5 are transmitted through the polarizing plate 7, they become infrared rays containing only a vertically oscillating component. When specular reflection occurs on the surface of the washbasin 14, an oscillating component of the reflected rays is only in a vertical direction because the reflected rays maintain their polarized state. In contrast with the diffuse reflection, rays are reflected in a particular direction in the specular reflection. Therefore, even if the distance between the sensor and the object causing reflection is large, the intensity of the reflected rays is kept high.

On the other hand, since the polarizing plate 8 allows only a horizontally oscillating component of the reflected rays to be transmitted, the infrared rays which are mirror-reflected on the surface of the washbasin do not enter the ray receiving section 6. Therefore, even if specular reflection is caused by the washbasin 14, it is not decided that the hands are sensed.

In the above description, the case where the reflection in the washbasin is purely diffuse reflection and the case where the reflection is purely specular reflection are described separately with reference to FIGS. 4 and 5, respectively. In practice, however, diffuse reflection and specular reflection simultaneously occur at a certain ratio. Nevertheless, since the effects on each type of the reflection are reduced in the present invention, an erroneous operation can be prevented without any problems even if both types of the reflection occur at any ratio.

INDUSTRIAL APPLICABILITY

In the present invention, the first and the second polarization means having different polarizing directions are mounted to the detection means for emitting infrared rays and for detecting the reflected infrared rays. Therefore, the mirror-reflected infrared rays can be eliminated to prevent erroneous sensing. Accordingly, it is suitable to be attached to a basin which is likely to cause specular reflection, such as a washbowl in a toilet, a washbasin in a lavatory, and a sink in the kitchen.

Since the polarization means for allowing different linearly polarized components to be transmitted are mounted to the ray emitting means and the ray receiving means of the automatic faucet control device, respectively, a mirror-reflected component, which adversely affects the detection of an object such as a hand, is eliminated so that a diffuse-reflected component is detected. As a result, reliable water flow control is made possible. Therefore, it is suitable for use in a toilet, a lavatory, or a kitchen or the like where erroneous detection is likely to occur due to specular reflection.

Moreover, since the polarizing plates whose planes of polarization perpendicularly cross each other are used as the polarization means, only the addition of extremely thin plate-like members to an infrared sensor of a conventional automatic faucet is required. Therefore, any change or addition of the circuit and the like is not required. Moreover, the shape is scarcely changed, and the waterproof structure of the sensor is not affected. Accordingly, not only a good design of a conventional automatic faucet is not impaired, but also either of the sensor according to the present invention or a conventional sensor can optionally be selected for use in accordance with the intended use of the automatic faucet. Therefore, it is useful in a toilet, a lavatory or a kitchen of which appearance is regarded as important.

Furthermore, when a glossy object such as a dish is detected, a mirror-reflected component is removed so as to detect only a diffuse-reflected component. As a result, since stable water flow control can be achieved, it is particularly suitable for use in a kitchen.

Furthermore, there are provided the steps of: emitting infrared rays on the first polarization means so that a transmitted linearly polarized component is incident on an object, and allowing the reflected rays to be incident on the second polarization means having a different polarizing direction from a polarizing direction of the first polarization means so as to detect only a linearly polarized component transmitted through the second polarization means. Therefore, since the mirror-reflected infrared rays can be removed to prevent erroneous sensing, it is suitable for use in a toilet, a lavatory, a kitchen and the like.

What is claimed is:

1. An automatic faucet control device having a detection means for detecting infrared rays of emitted infrared light, the infrared rays being incident on a target to be detected and being reflected thereby, so as to sense the target coming closer to a spout and then to allow water to automatically run, the device being attached to a washbowl, a washbasin, or a sink, wherein the infrared rays of the detection means are directed toward the washbowl, the washbasin, or the sink;

the detection means includes: a first polarization means for allowing a linearly polarized component of the emitted infrared rays to be transmitted therethrough and a second polarization means for allowing a linearly polarized component of received infrared rays to be transmitted therethrough; and planes of polarization of the first polarization means and the second polarization means cross each other, so that the detection means does not detect mirror-reflected rays from a surface of the washbowl, the washbasin, or the sink but detects diffuse-reflected rays from the target.

2. An automatic faucet control device attached to a washbowl, a washbasin, or a sink, comprising: an electromagnetic valve for opening and closing a flow channel of a faucet, a ray emitting means for emitting infrared rays to a target to be detected, a ray receiving means for receiving the infrared rays reflected by the target, a sensing decision means for deciding presence or absence of the target by an output from the ray receiving means, and an electromagnetic valve control means for controlling the electromagnetic valve based on a sensing signal from the sensing decision means, wherein the ray emitting means has a first polarization means for allowing a polarized component to be transmitted therethrough; and the ray receiving means has a second polarization means for allowing a polarized component different from the rays transmitted through the first polarization means to be transmitted therethrough, so that mirror-reflected rays from a surface of the washbowl, the washbasin, or the sink are not detected but diffuse-reflected rays from the target are detected, whereby the sensing decision means determines the presence of the target.

3. The automatic faucet control device according to claim 2, wherein the first and the second polarization means are polarizing plates provided so that their planes of polarization perpendicularly cross each other.

4. A control method of an automatic faucet attached to a washbowl, a washbasin, or a sink, for detecting infrared rays of emitted infrared light, the infrared rays being incident on a target to be detected and being reflected thereby, and for sensing the target coming closer to a spout and then to allow water to automatically run, the infrared rays being directed toward the washbowl, the washbasin, or the sink, the method comprising the steps of:

emitting the infrared rays to a first polarization means to allow a linearly polarized component to be transmitted therethrough so that the linearly polarized component is incident on an object; and allowing reflected rays of the linearly polarized component reflected by the object to be incident on a second polarization means having a plane of polarization crossing a plane of polarization of the first polarization means so as to detect only a linearly polarized component transmitted through the second polarization means, whereby mirror-reflected rays from a surface of the washbowl, the washbasin or the sink are not detected, but diffuse-reflected rays from the object are detected to allow water to run.

* * * * *